US012497855B1

(12) United States Patent
Selvamurugan

(10) Patent No.: US 12,497,855 B1
(45) Date of Patent: Dec. 16, 2025

(54) SHEAR RESISTANT SWELLABLE PACKERS

(71) Applicant: Halliburton Energy Services, Inc., Houston, TX (US)

(72) Inventor: Ramya Priyadarsini Selvamurugan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/746,256

(22) Filed: Jun. 18, 2024

(51) Int. Cl.
*E21B 33/127* (2006.01)
*E21B 33/12* (2006.01)
*E21B 33/124* (2006.01)

(52) U.S. Cl.
CPC ..... *E21B 33/127* (2013.01); *E21B 33/1204* (2013.01); *E21B 33/1243* (2013.01)

(58) Field of Classification Search
CPC ..... E21B 33/1208; E21B 33/127; E21B 33/1216; E21B 33/1243; E21B 33/1204
See application file for complete search history.

(56) References Cited

U.S. PATENT DOCUMENTS 1,026,310 A * 5/1912 Hammond et al. ..... B60T 15/54 303/79
2,184,634 A 12/1939 Crickmer et al.
3,529,667 A * 9/1970 Malone ..... E21B 33/127 166/387
7,849,930 B2 * 12/2010 Chalker ..... E21B 33/1208 166/387
9,016,391 B1 4/2015 Chauffe
9,453,387 B2 * 9/2016 Andersen ..... E21B 33/1216
9,453,872 B2 * 9/2016 Kusaka ..... G01R 31/2619
9,976,383 B2 5/2018 Gordon et al.
10,113,388 B2 10/2018 Stewart et al.
11,299,955 B2 4/2022 Fripp et al.
11,473,391 B2 10/2022 Jakkula et al.
(Continued)

FOREIGN PATENT DOCUMENTS

CA 2875943 3/2014

OTHER PUBLICATIONS

Pradie, E. C., Jaafar, M. R., Barnes, C. G., Gjelstad, G., & Smith, P. E. (2008). Corroded Casing: Testing of Sealing Capability and Retrievability of a Swelling Elastomer Packer. SPE Annual Technical Conference and Exhibition.
(Continued)

*Primary Examiner* — Yong-Suk (Philip) Ro
(74) *Attorney, Agent, or Firm* — Scott Richardson; C. Tumey Law Group PLLC

(57) ABSTRACT

Disclosed are a variety of methods and systems related to zonal isolation in wellbores, and more particularly, swellable packer assemblies. In embodiments, a swellable packer includes a base conduit, a reinforcement element disposed annularly about the base conduit, that includes an annular section, a stabilizing foot to stabilize the annular section relative to the base conduit, and a swellable material annularly disposed outside the base conduit and in contact with the reinforcement element. In other embodiments, the swellable packer is introduced in a run-in-hole position into a borehole or wellbore, wherein the swellable material absorbs fluid and expands, thereby applying a gripping force to a region of the borehole or wellbore to seal off an annulus around the swellable packer.

18 Claims, 6 Drawing Sheets

(56) References Cited

U.S. PATENT DOCUMENTS

| | | | | |
|---|---|---|---|---|
| 2007/0151724 | A1* | 7/2007 | Ohmer | E21B 47/01 166/187 |
| 2009/0229816 | A1* | 9/2009 | Lemme | E21B 33/1216 264/273 |
| 2016/0053570 | A1* | 2/2016 | Andersen | E21B 33/1216 166/179 |
| 2017/0356269 | A1* | 12/2017 | Denton | E21B 33/1208 |
| 2018/0087346 | A1 | 3/2018 | Rochen | |
| 2019/0360297 | A1* | 11/2019 | Heiman | E21B 33/128 |
| 2023/0003302 | A1 | 1/2023 | Uchiyama | |

OTHER PUBLICATIONS

International Search Report and Written Opinion for International Patent Application No. PCT/US2024/036588 dated Mar. 11, 2025. PDF file. 8 pages.

* cited by examiner

SHEAR RESISTANT SWELLABLE PACKERS

BACKGROUND

The oil and gas industry may use boreholes as fluid conduits to access subterranean deposits of various fluids and minerals which may include hydrocarbons. A drilling operation may be utilized to construct the fluid conduits which are capable of producing hydrocarbons disposed in subterranean formations. Swellable packers are commonly used to provide zonal isolation between sections of a wellbore or borehole. A swellable packer may be lowered, e.g., on a tool string, and run downhole in a run-in-hole (RIH) position to a target depth. The swellable material of the packer then expands to seal off the annular region around the packer, thereby providing the zonal isolation. Swellable packers are often permanent installations that replace cement operations.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
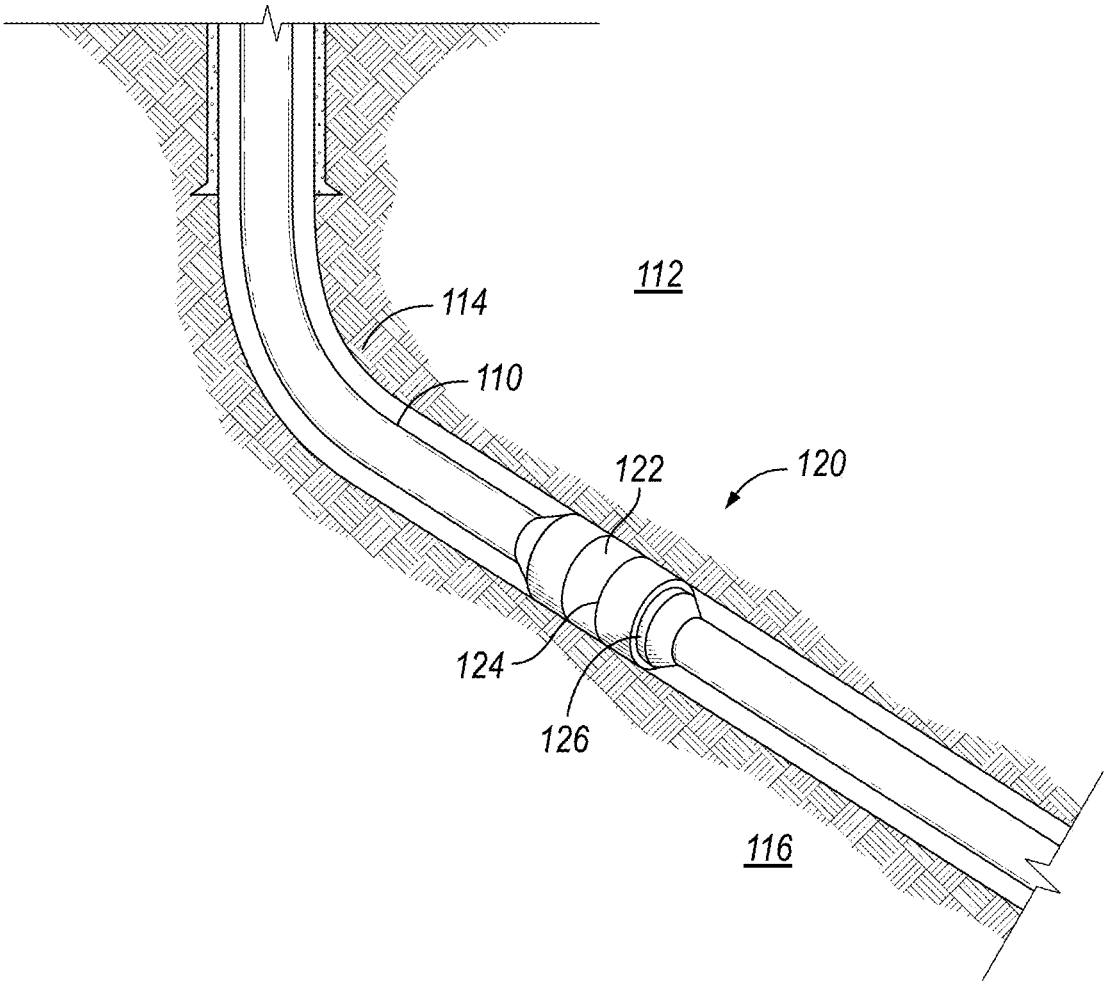
FIG. 1 illustrates a swellable packer in a borehole in accordance with some embodiments of the present disclosure.

Disclosed herein are methods and apparatuses for zonal isolation in wellbores, and more particularly, disclosed is a swellable packer assembly. Even more particularly, disclosed are reinforcement elements that reinforce swellable material disposed around a base conduit of a swellable packer.

Advantages of the swellable packer assembly of the present disclosure may include, without limitation, improved resistance to shear to the swellable materials disposed on the outside of a swellable packer and increased load capacity or differential pressure holding capability of the swellable packer without complicating the manufacturing process of the swellable packer. Specifically, one or more stabilizing features (e.g., stabilizing foot) annularly disposed on a reinforcement element may stabilize the reinforcement element on the base conduit of the swellable packer. Furthermore, the stabilizing feature(s) may prevent the reinforcement element from warping or tilting on the outside of the base conduit during and after placement of the swellable material around the swellable packer.

In general, a swellable packer assembly may include a base conduit, one or more annular elements which includes one or more stabilizing features, e.g., stabilizing foot, and one or more swellable materials wrapped or otherwise disposed concentrically around at least a portion of the base conduit, the annular element, and the stabilizing feature, wherein the swellable material is configured to swell after being run downhole in a run-in-hole (RIH) position to achieve zonal isolation with an expanded position after being exposed to downhole fluids.

A method of manufacturing the packer assembly may include securing the one or more annular elements about the base conduit so that the stabilizing feature may contact a surface of the base conduit to stabilize the annular element, and then wrapping or else disposing the swellable material annularly around at least a portion of the base conduit, the annular element, and the stabilizing feature.

A method of using the swellable packer assembly may involve lowering the swellable packer assembly into a borehole or wellbore, and once the swellable packer assembly reaches its target depth, allowing the swellable material disposed around at least a portion of the base conduit, the annular element(s), and the stabilizing feature(s) to expand, to thereby engage a borehole wall or an inner diameter of a casing to achieve zonal isolation with the expanded position.

The term "swell" and similar terms (such as "swellable") are used herein to indicate an increase in volume of a swellable material. Typically, this increase in volume is due to incorporation of molecular components of an activating agent (e.g., gas, water, and/or oil) into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material in one or more examples of the present disclosure may comprise water and/or a hydrocarbon fluid (such as oil or gas). In a well system, the swellable material swells when a fluid comprising the activating agent enters a borehole or wellbore from a formation surrounding the borehole or wellbore, or when fluid is circulated to the swellable packer assembly from the surface, or when fluid is released from a vessel or chamber carried with or alongside the packer assembly, etc. In response, the swellable material swells to seal off an annulus around the swellable packer assembly and thus applies a gripping force to that section of the wellbore or borehole.

Swellable materials suitable for use in embodiments of the swellable packer assembly may generally swell by up to about 50% or more of their original size at the surface as long as it is in contact with the fluid until reaching the casing internal diameter (ID) or open hole ID. Under downhole conditions, this swelling may be more (or less) dependent on the conditions presented. For example, the swelling may be about 10% or more at downhole conditions. In some embodiments, the swelling may be about 50% or more under downhole conditions. However, as those of ordinary skill in the art, with the benefit of this disclosure, will appreciate, the actual swelling of the swellable material may vary, for example, based on the concentration of, e.g., swellable polymer included in the swellable material, among other factors.

In some examples, a swellable material may include an elastomer. This may include a variety of elastomers such as natural, synthetic, thermoplastic, and thermosetting elastomers, which may be swellable. Some specific examples of swellable elastomers include, without limitation, natural rubber, acrylate butadiene rubber, polyacrylate rubber, isoprene rubber, chloroprene rubber, butyl rubber (IIR), brominated butyl rubber (BIIR), chlorinated butyl rubber (CIIR), chlorinated polyethylene rubber (CM/CPE), neoprene rubber (CR), styrene butadiene copolymer rubber (SBR), sulphonated polyethylene (CSM), ethylene acrylate rubber (EAM/AEM), epichlorohydrin ethylene oxide copolymer rubber (CO,ECO), ethylene-propylene rubber (EPM and EDPM), ethylene-propylene-diene terpolymer rubber (EPT), ethylene vinyl acetate copolymer, fluorosilicone rubbers (FVMQ), silicone rubbers (VMQ), poly 2,2,1-bicyclo heptane (polynorbornene), and alkyl styrene. One example of a suitable swellable elastomer comprises a block copolymer of styrene-butadiene rubber. Examples of suitable elastomers that swell in contact with oil include, but are not limited to, nitrile rubber (NBR), hydrogenated nitrile rubber (HNBR, HNS), fluoro rubbers (FKM), perfluoro rubbers (FFKM), tetrafluorocthylene/propylene (TFE/P) and isobutylene maleic anhydride.

In some examples, the swellable material may be water-swellable. Water-swellable elastomers may, for example, be derived from monomers which may include butadiene, chloroprene or isoprene copolymerized with monomers which produce polymers that are water-swellable. Additional monomers may include open-chain conjugated dienes having from 5 to 8 carbon atoms, such as 2,3-dimethylbutadiene, 1,4-dimethylbutadiene, and piperylene. In some embodiments, the monomers may be copolymerized with a monomer which may render the swellable material water swellable, such as unsaturated polymerizable carboxylic acid (e.g., maleic acid, fumaric acid, etc.), sulfonic acids, and phosphoric acids. Polymerizable unsaturated molecules which contain more than one sulfonic, sulfate, phosphoric, or phosphate group may also be suitable for copolymerization with the monomers. Elastomeric copolymers containing monomers having water susceptible groups such as amides, amines and hydroxyl may also be used in some embodiments. Examples of such monomers may include, without limitation, furanamine, acrylamide, and methacrylamide. Copolymers of any combination of the above monomers with monomers containing conjugated unsaturation may be obtained by copolymerizing the elastomeric engendering monomer with monomers that may be reacted to provide water swellability. Such polymers may include copolymers of diene monomers with acrylonitrile, acrylate esters and amides, methacrylate esters and amides, and maleic anhydride. These copolymers may be hydrolyzed to provide copolymers containing unsaturated chemical units and carboxylic acid units. Other reactions to provide suitable elastomers may include reactions on polymers such as hydrolysis of copolymers of vinyl acetate to give hydroxyl groups, ammonolysis of ester groups to give amide groups, and sulfonation to give elastomers which have sulfonic acid groups. Combinations of swellable elastomers may also be used. Other elastomers that behave in a similar fashion with respect to oil or aqueous fluids may also be suitable.

In some examples, the swellable material may comprise a water swellable polymer. By way of example, a water-soluble polymer may include any of a variety of polymers that swell upon contact with water. Some specific examples of water-swellable polymers include, but are not limited to, super-absorbent polymers (such as polymethacrylate and polyacrylamide) and non-soluble acrylic polymers (such as starch-polyacrylate acid graft copolymer and salts thereof), polyethylene oxide polymers, carboxymethyl cellulose type polymers, poly(acrylic acid) and salts thereof, poly(acrylic-co-acrylamide) and salts thereof, graft-poly(ethylene oxide) of poly(acrylic acid) and salts thereof, poly(2-hydroxyethylmethacrylate), poly(2-hydroxypropyl methacrylate), polyvinyl alcohol cyclic acid anhydride graft copolymer, isobutylene maleic anhydride, vinyl acetate-acrylate copolymer, and starch-polyacrylonitrile graft copolymers. Combinations of water-swellable polymers may also be suitable. Other polymers that behave in a similar fashion with respect to aqueous fluids also may be suitable.

In some examples, the swellable material ma be dual oil/water swellable. For example, a polymer may comprise a combination or mixture of both oil-swellable and water-swellable materials. A polymer is characterized as "dual oil/water-swellable" when it swells upon contact with oil and also swells upon contact with aqueous fluids. In some examples, an oil-swellable material and/or a water-swellable material may comprise an elastomer. For example, ethylene-propylene polymer (e.g., ethylene-propylene copolymer rubber or ethylene-propylene-diene terpolymer rubber) and bentonite. By way of further example, the swellable polymer may comprise a butyl rubber and sodium bentonite.

Example methods of a swellable packer that includes a swellable material will now be described in more detail with references to FIGS. 1-8. FIG. 1 illustrates a swellable packer 120 in a borehole 114 in accordance with some embodiments of the present disclosure. As shown, a borehole 114 may extend into a subterranean formation 112. FIG. 1 shows a borehole 114 without casing, however the swellable packer 120 may also be used in wellbores having casing. In this FIG. 1, the swellable packer 120 is shown on a tubular string 110 that extends into the borehole 114. Tubular string 110 may comprise any suitable tubular such as production tubing, a casing string, completion string, or other tubular assembly as would be known by a skilled person in the art. The swellable packer 120 is shown in an expanded or swollen configuration with the swellable material 122 generating a swell force against the borehole wall of borehole 114. Reinforcement elements 124 are also schematically represented along an axial length of swellable packer 120 to provide reinforcement to the swellable material 122 wrapped around a base conduit 126 and thus reduce or prevent the likelihood of shear of the swellable material 122 due to differential wellbore pressure across the swellable packer 120 on either side 114, 116 of the packer. Thus, the swellable packer 120 may provide zonal isolation to a region of the borehole 114. While FIG. 1 shows swellable packer 120 disposed in a borehole 114, swellable packer 120 may likewise be disposed in any hole extending into the formation, be it cased or open hole. Typically, a swellable packer 120 is a permanent installation that once swollen into an expanded configuration, is not generally removed from borehole 114.

Figure 2B:
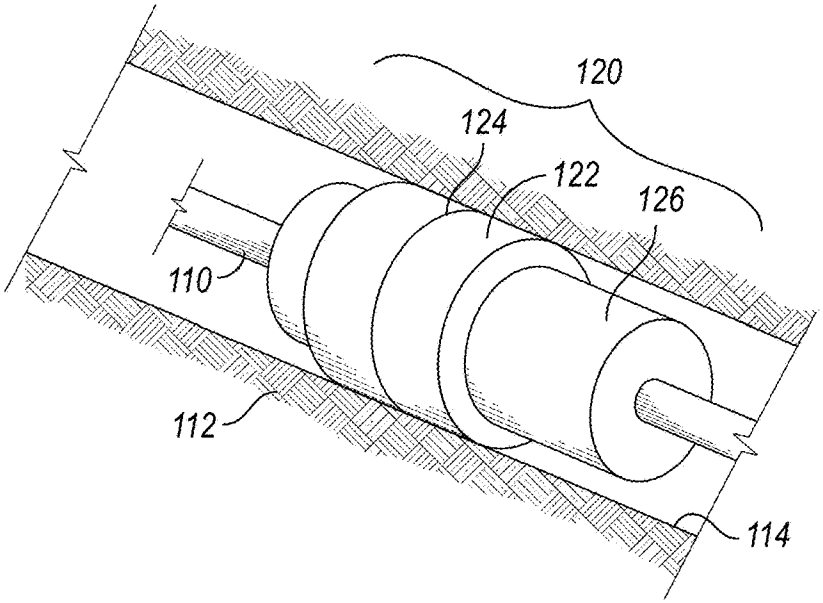
FIG. 2B illustrates the swellable packer of FIG. 2A in an expanded configuration, in accordance with some embodiments of the present disclosure.
Figure 2A:
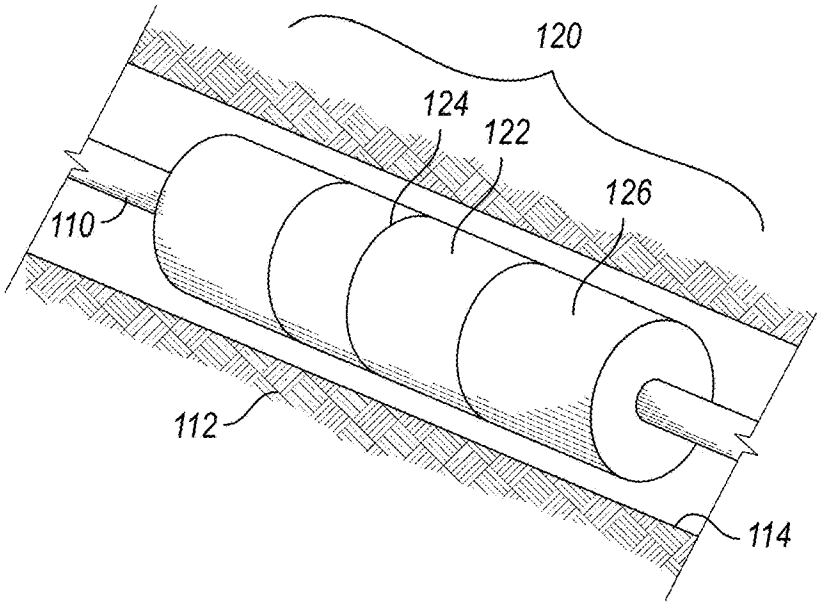
FIG. 2A illustrates a swellable packer in a run-in-hole configuration, in accordance with some embodiments of the present disclosure.

FIG. 2A illustrates a swellable packer in a run-in-hole (RIH) configuration, in accordance with some embodiments of the present disclosure. As illustrated, an RIH configuration may comprise the swellable packer 120 having the swellable material 122 disposed about the base conduit 126 relaxed and in a non-expanded configuration. In this example, a reinforcement element 124 is visible to section off regions of the swellable material 122. In examples, due to the swelling of the swellable material 122, a separate setting mechanism is not needed to expand the swellable packer 120 as the material itself expands by absorbing fluid into interstitial regions of its matrix. As shown, the swellable material 122 does not contact the surface of the borehole 114 while in the RIH configuration.

However, in the expanded configuration, the swellable material 122 applies an outward gripping force and contacts the borehole 114. Accordingly, FIG. 2B illustrates the swellable packer 120 of FIG. 2A, but in an expanded configuration, in accordance with some embodiments of the present disclosure. A solid line schematically showing the position of reinforcement element 124 shows that it is disposed within various sections of the swellable material 122 about the base conduit 126.

To delay swelling of the swellable material, a delay barrier may be applied to an outer circumference of the swellable packer to prevent premature swelling prior to reaching the desired setting location.

While this figure shows the surface of borehole 114 as a straight line, it should be noted that the open hole is not a smooth, concentric surface but may be a crannied surface, e.g., previously roughened during drilling. When the swellable material 122 expands (e.g., to 130% or more of its original volume), it anchors the swellable packer 120 at that location in the borehole 114. There is a demand for higher differential pressure capabilities of swellable packers. However, there are engineering constraints that limit higher differential pressure capabilities, such as those imposed by the natural softening of the materials that results as a consequence of the swelling (because oil or water permeates the matrix of the swellable material 202). There is a direct relationship between the percent volumetric expansion of the swellable material 202 and its susceptibility to shear. Thus, there is an inverse relationship between the percent volumetric expansion of a given swellable material 202 and a swell packer's 120 differential pressure holding capability. The reinforcement element 122 of the present disclosure is aimed to address these and other problems and allows for greater holding capability as well as a greater tolerance for more volumetric expansion of the swellable material 202 without adversely impacting the swell packer's 120 holding capacity. Without being limited by theory, reinforcement element 122 may redistribute the differential pressure across a greater surface area, e.g., at the interface between swellable material 202 and the swellable material 202 bonded or extruded/wrapped around reinforcement element 122 and the base conduit 204.

Figure 3:
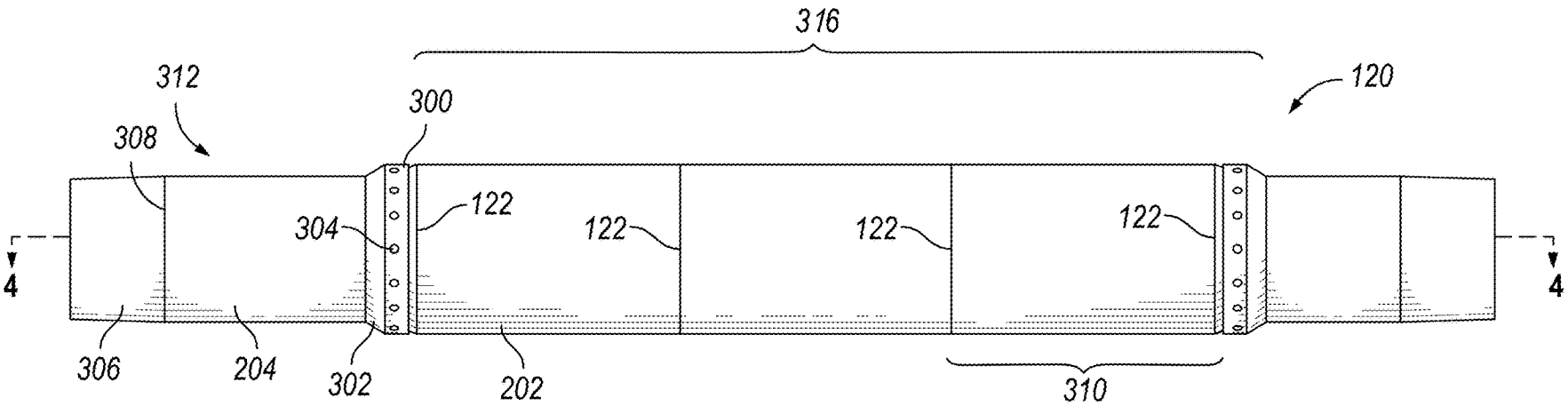
FIG. 3 is a schematic of a swellable packer, in accordance with some embodiments of the present disclosure.

Accordingly, FIG. 3 is a schematic of a swellable packer 120, in accordance with some embodiments of the present disclosure. As shown, swellable packer 120 may include a base conduit 204 having one or more reinforcement elements 122 annularly disposed about the base conduit 204. Swellable material 202 is likewise disposed annularly about the base conduit 204 between the reinforcement elements 122. In some examples, the base conduit 214 transitions at 308 to a tapered or threaded region 306 which has a constricted outer diameter with respect to that of base conduit 204. While FIG. 3 shows, in this example, four reinforcement elements 122, a swellable packer 120 may include any suitable number, e.g., 1, 2, 3, 5, 6, 10, or more.

End rings 300 are likewise annularly disposed around the base conduit 204 to contain the swellable material 202 axially within a swelling region 316 of the swellable packer 120. End rings 300 may have metal-to-metal (MTM) contact with the base conduit 204 and may be held in place in any suitable fashion, such as by using set screws 304 concentrically disposed about each end ring 300. The MTM seal is achieved by the set screws biting on the base conduit. Each end ring 300 may also have a tapered region 302 on the other side of the set screws 304 to incur lesser damage during run in hole, and provide a MTM contact with the base conduit 204, to assist along with an exposed portion 312 of the base conduit 204, with handling of the swellable packer 120, in some examples.

Reinforcement elements 122 may be disposed concentrically about the base conduit 204 in any suitable fashion, and in any suitable density, to provide the appropriate amount of resistance to shear to the swellable material 202. In examples, a distance 310 between one or more of the reinforcement elements 122 may be about one foot or one reinforcement plate per foot of rubber element. Alternatively, from about 5 cm to about 10 cm, about 10 cm to about 20 cm, about 20 cm to about 30 cm, about 30 cm to about 40 cm, or any ranges therebetween.

During manufacturing of the swellable packer 120, the reinforcement elements 122 are slid to their appropriate axial location on the base conduit 204. Primer and/or adhesive may be coated using any suitable technique (spray coating, dipping, deposition, sputtering, physical deposition, vapor deposition, etc.) on the reinforcement elements 122 and the base conduit 204 to prepare their respective surfaces (e.g., surfaces 506, 508, and 518 of FIG. 5) for application of the swellable material 202. Swellable material 202 may be disposed concentrically around the base conduit 204 in any suitable fashion, such as by wrapping with an extruded feed of the swellable material 202. Once disposed on the outer surface of the base conduit 204 and the reinforcement elements 122, the swellable material 202 may be vulcanized, e.g., using water steam vulcanization or other vulcanization technique. The swellable material 202 may thus chemically bind to the base conduit 204 and these surfaces.

Figure 4:
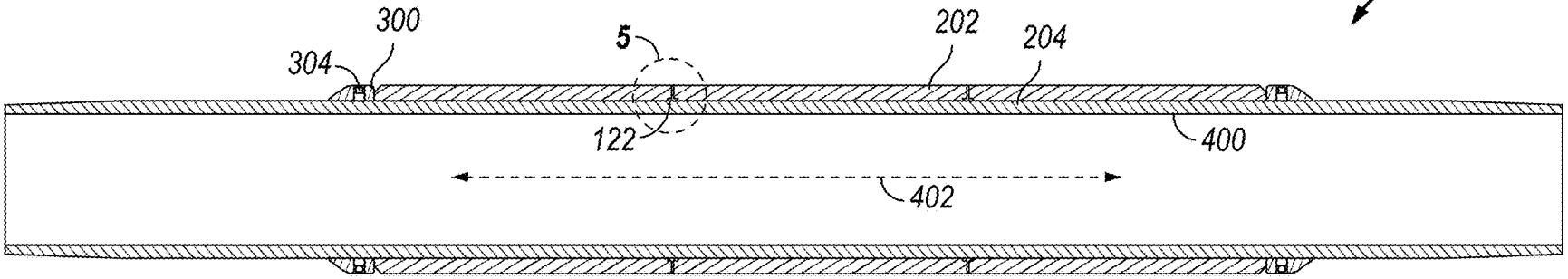
FIG. 4 shows a cross-section of the swellable packer of FIG. 3, in accordance with some embodiments of the present disclosure.

FIG. 4 shows a cross-section of the swellable packer 120 of FIG. 3, in accordance with some embodiments of the present disclosure. As shown, an end ring 300 may be held in place by set screws 304 at either end of the swelling region 316 (e.g., referring to FIG. 3) to contain the swellable material 202 within the region and ensure the appropriate outward radial expansion upon exposure to the activating fluid. The base conduit 204 may have a bore 400 that allows fluids (e.g., hydrocarbon fluid, drilling fluid, circulating fluid, cleaner fluid, sealing pill, cement, acid, brine, treatment fluid, etc., or any suitable wellbore or borehole fluid) to traverse the swellable packer along an axis indicated at 402 when the swellable packer 120 is installed at its appropriate location within borehole 114 (e.g., referring to FIGS. 1-2A). Such flow of fluid may involve downgoing or upgoing fluids, depending on the specific type of well operation. The reinforcement element 122 may comprise any suitable geometric shape such as one having a T-shaped cross section, as illustrated or an I-shaped cross section, for example. Alternatively, a triangular, curved, winding (e.g., referring to FIG. 9), or other suitable shape or geometry.

However, advantageously, a T-shaped cross section and/or other geometries may allow for, e.g., a stabilizing foot (e.g., stabilizing foot 502 of FIG. 5) to stabilize the reinforcement element 122 to prevent it from warping or tilting during or after placement of the swellable material 202 around the base conduit 400 (e.g., during expansion of swellable material 202 or while swellable packer 120 is experiencing a load/pressure differential), as discussed.

Figure 5:
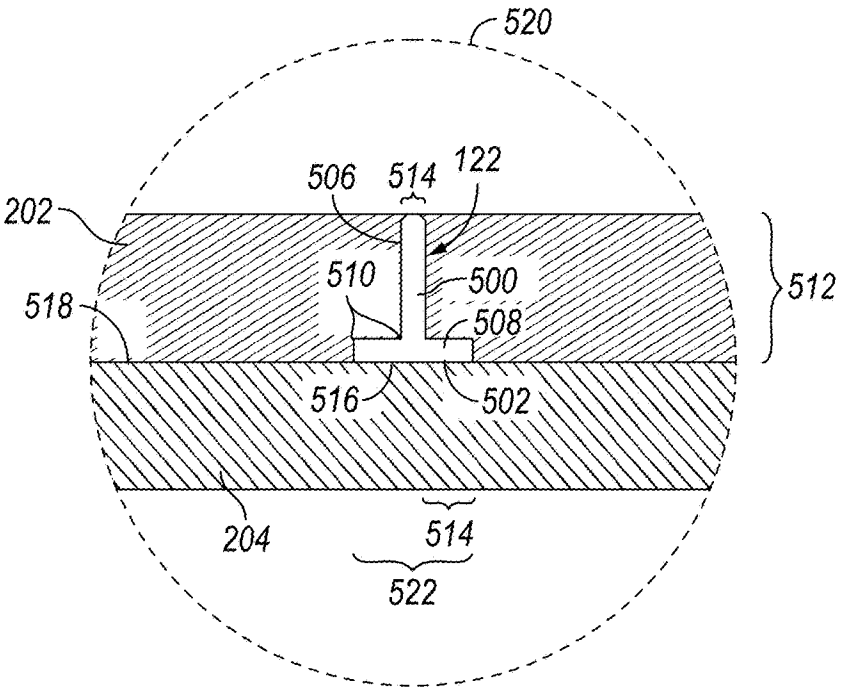
FIG. 5 is a close-up view of part of the cross-section shown in FIG. 4 to show the reinforcement element with a stabilizing foot, in accordance with some embodiments of the present disclosure.

FIG. 5 is a close-up view of part of the cross-section shown in FIG. 4 to show the reinforcement element 120 including a stabilizer foot 502, in accordance with some embodiments of the present disclosure. As shown, the reinforcement element 120 is disposed within the annular scaling element 202 and may include an annular section 500 biased radially outwards from the base conduit 204 and one or more (in this case, two) stabilizing foot 502 to stabilize the annular section 500. Annular section 500 is shown as being perpendicular to the base conduit 204 but may be disposed in any suitable fashion that allows it to redistribute load to the swellable material 202 such as by being angled, e.g., between 5 degrees and 90 degrees from a central axis indicated at 402 in either direction (uphole or downhole). Annular section 500 may extend out from base conduit 204 by a distance 510 which may be, for example, about 1 millimeter (mm) to about 5 cm, or any ranges therebetween. Stabilizing foot 502 may extend axially away from where it intersects with annular section 500 by a distance 514 which may be, for example, about 1 millimeter to about 2 cm, or any ranges therebetween. A height 512 of annular section 500 may be, in some examples, equal to or greater than the distance 514 of a stabilizer foot 502, for example, at least two times greater, at least three times greater, or more. In other examples, the height 512 of annular section 500 may be equal to or greater than the width 522 of an interface 516 between reinforcement element 500 and base conduit 204, for example, at least two times greater, at least three times greater, or more. As discussed, stabilizer foot 502 may prevent reinforcement element 122 from warping or tilting during or after placement of swellable material 202 around the base conduit 204. Likewise, distance 522 of an interface 516 (where reinforcement element may contact the base conduit 204) may be greater (e.g., at least two, three, or four times greater, or more) than distance 520 (an axial length of the annular section 500). Furthermore, the specific geometry of reinforcement element 122 may redistribute load to the reinforcement element 122 better than if reinforcement element 122 were merely to comprise, e.g., a single annular disc extending out perpendicularly from the base conduit 204. FIG. 5 also shows an interface 516 between the reinforcement element 122 and the base conduit 204 which may be, for example, an MTM connection. Interface 516 may, in some examples, be therefore void of any sleeve (e.g., metal sleeve) interposed between reinforcement element 122 and base conduit 204. (Some types of packers, such as slip on packers, use metal sleeves disposed outside a base conduit 204). As with surface 518 (the outer diameter (OD) of the base conduit 204 that is exposed to the swellable material 202), respective surfaces 506 and 508 of annular element 122 may be prepared (primed and/or covered with adhesive) and covered with the swellable material 202 as, e.g., it is extruded and/or adhered around the base conduit 204. While FIG. 5 shows various corners or edges 510, these may be replaced with curved, chamfered, or beveled surfaces or configured in various other ways to effectuate the same purpose, as would be readily apparent to one of ordinary skill of the art with the benefit of this disclosure.

Figure 8:
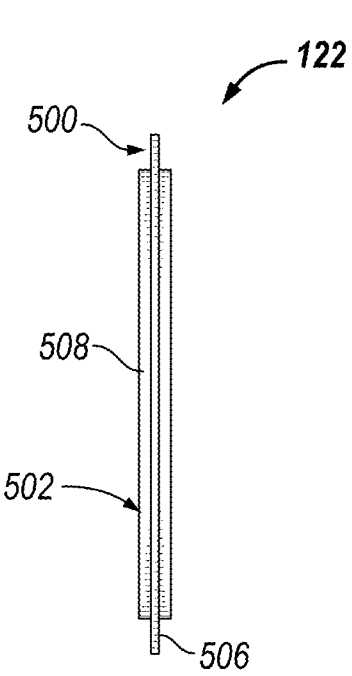
FIG. 8 illustrates a size view of the reinforcement element of FIGS. 6, and 7, in accordance with some embodiments of the present disclosure.
Figure 7:
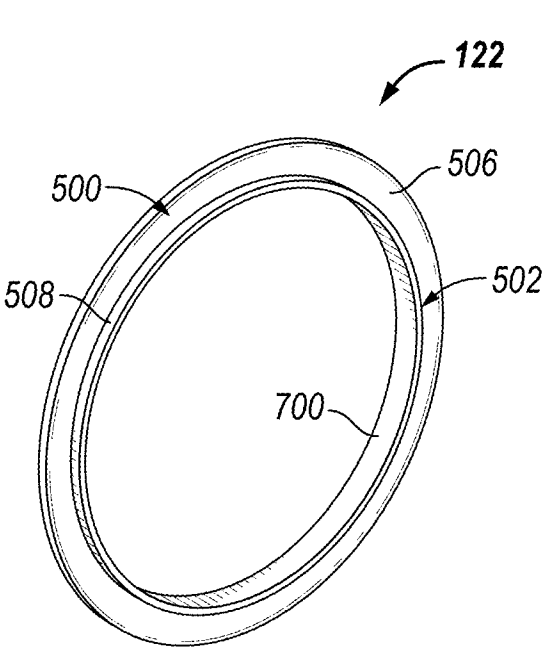
FIG. 7 illustrates a perspective view of the reinforcement element of FIG. 6, in accordance with some embodiments of the present disclosure.
Figure 6:
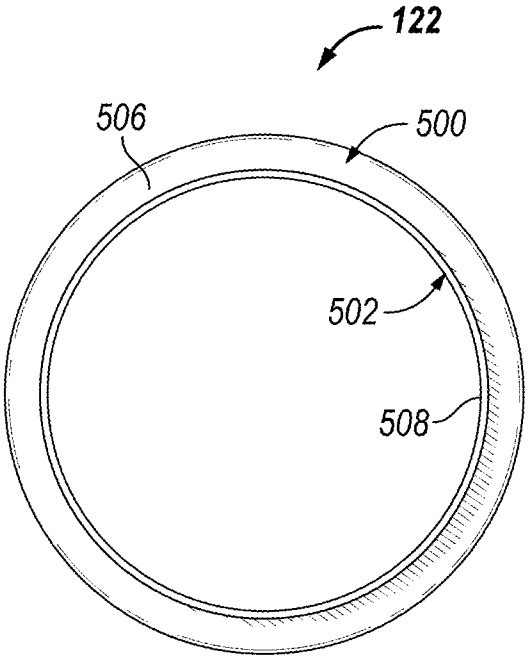
FIG. 6 illustrates the reinforcement element of FIG. 5, in accordance with some embodiments of the present disclosure.

FIG. 6 illustrates the reinforcement element 122 of FIG. 5, in accordance with some embodiments of the present disclosure. As illustrated, reinforcement element 122 may include an annular section 500 and a stabilizer foot 502 having surfaces 506, 508 respectively, to adhere to the swellable material 202 (e.g., referring to FIGS. 1-5). FIG. 7 illustrates a perspective view of the reinforcement element 122 of FIG. 6, in accordance with some embodiments of the present disclosure, likewise showing the surfaces 506, 508 of the annular section 500 and stabilizer foot 502, respectively. This view also shows an inner diameter 700 of the reinforcement element 122 which may be slid along a base conduit 204 during manufacture of the swellable packer 120 (e.g., referring to FIG. 1-4). FIG. 8 illustrates a size view of the reinforcement element 122 of FIGS. 6 and 7, in accordance with some embodiments of the present disclosure. This view likewise shows the surfaces 506, 508 of the annular section 500 and the stabilizer foot 502, respectively.

Figure 9:
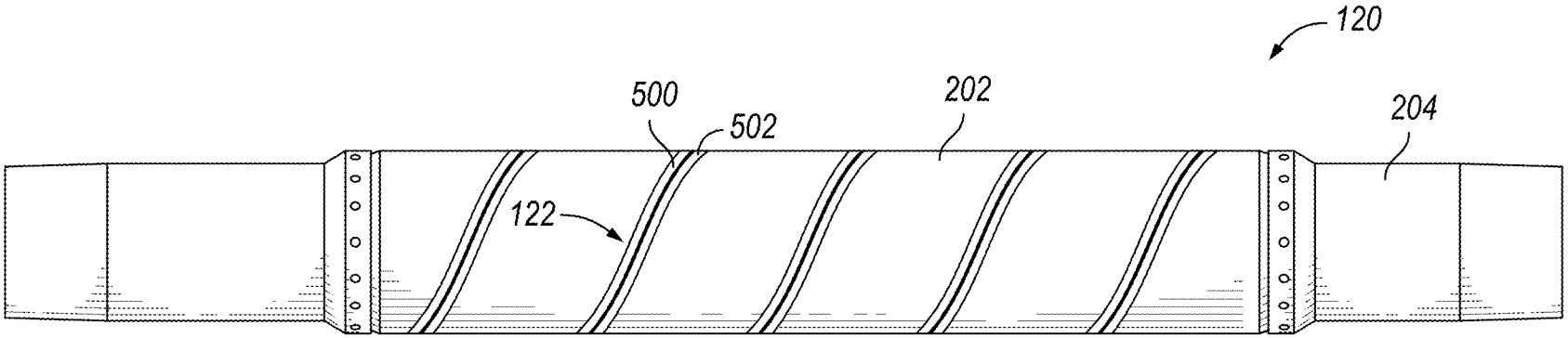
FIG. 9 is a schematic of a swellable packer with the reinforcement element helically disposed around the base conduit, in accordance with some embodiments of the present disclosure

FIG. 9 is a schematic of a swellable packer 120 with a reinforcement element 122 helically disposed around the base conduit 204, in accordance with some embodiments of the present disclosure. As an alternative example to that shown by previous FIGS. (e.g., FIGS. 1-8), the reinforcement element 122 may be complexly disposed about the concentric surface of the base conduit 204 in any suitable manner such as the winding, helical fashion shown by FIG. 9. In this example, the swellable material 202 is disposed within the various windings of the reinforcement element 122. The geometry of the reinforcement element 122 may—as with previous examples—redistribute shear across the swellable material 202 associated with the pressure differential across the swellable packer 120 and thus preserve the tool's longevity and performance or increase its load bearing capabilities, as discussed. While FIG. 9 shows an annular section 500 and stabilizer foot 502 which may be bilateral, winding the annular section 500 around the base conduit 204 may reduce or eliminate the need for stabilizer foot 502, in some examples.

Accordingly, the present disclosure may provide a reinforcement element disposed around the base conduit of a swellable packer to reduce shearing of the swellable material disposed around the outside of the swellable packer which would otherwise be caused by the pressure differential applied across the swellable packer during various well operations. The methods and tools may include any of the various features disclosed herein, including one or more of the following statements.

Statement 1. A swellable packer, comprising: a base conduit; a reinforcement element disposed annularly about the base conduit, comprising: an annular section; and a stabilizing foot to stabilize the annular section relative to the base conduit; and a swellable material annularly disposed outside the base conduit and in contact with the reinforcement element.

Statement 2. The swellable packer of Statement 1, wherein a height of the annular section is greater than a width of the stabilizing foot.

Statement 3. The swellable packer of Statement 1 or Statement 2, wherein the height of the annular section is at least two times the width of the stabilizing foot.

Statement 4. The swellable packer of any one of the previous Statements, wherein a width of an interface between the reinforcement element and the base conduit is greater than a width of the annular section.

Statement 5. The swellable packer of any one of the previous Statements, wherein the swellable packer is in: a run-in-hole position; or an expanded position.

Statement 6. The swellable packer of any one of the previous Statements, wherein the reinforcement element comprises a plurality of non-helical discs distributed across an axial length of a swelling section of the swellable packer.

Statement 7. The swellable packer of any one of the previous Statements, wherein the reinforcement element is disposed helically around the base conduit.

Statement 8. The swellable packer of any one of the previous Statements, wherein the annular section and the stabilizing foot form a "T" shape.

Statement 9. A method, comprising: introducing a swellable packer in a run-in-hole position into a borehole or wellbore, wherein the swellable packer comprises: a base conduit; a reinforcement element, comprising: an annular section; and a stabilizing foot to stabilize the annular section relative to the base conduit; and a swellable material concentrically disposed outside the base conduit and in contact with the reinforcement element, wherein the swellable material absorbs fluid and expands, thereby applying a gripping force to a region of the borehole or wellbore to seal off an annulus around the swellable packer.

Statement 10. The method of Statement 9, wherein a height of the annular section is greater than a width of the stabilizing foot.

Statement 11. The method of Statement 9 or Statement 10, wherein the height of the annular section is at least two times the width of the stabilizing foot.

Statement 12. The method of any one of Statements 9-11, wherein a width of an interface between the reinforcement element and the base conduit is greater than a width of the annular section.

Statement 13. The method of any one of Statements 9-12, wherein the swellable material comprises a water-swelling material, an oil-swelling material, or both.

Statement 14. The method of any one of Statements 9-13, wherein the reinforcement element comprises a plurality of non-helical structures distributed across an axial length of a swelling section of the swellable packer.

Statement 15. The method of any one of Statements 9-14, wherein the reinforcement element is disposed helically around the base conduit.

Statement 16. The method of any one of Statements 9-15, wherein the annular section and the stabilizing foot form a "T" shape.

Statement 17. A method, comprising: sliding one or more reinforcement elements along an outer diameter of a base conduit, wherein at least one reinforcement element comprises, a stabilizing foot to stabilize an annular section relative to the base conduit; and depositing a swelling material annularly about the base conduit and the one or more reinforcement elements.

Statement 18. The method of Statement 17, further comprising: applying primer and/or adhesive to the base conduit and the one or more reinforcement elements; and vulcanizing the swelling material using steam vulcanization.

Statement 19. The method of Statement 17 or Statement 18, wherein the one or more reinforcement elements comprises: a plurality of non-helical structures disposed axially along a length of a swelling section of the base conduit; or a helical structure winding around the base conduit.

Statement 20. The method of any one of Statements 17-19, wherein a height of the annular section is greater than a width of the stabilizing foot; and/or a width of an interface between at least one reinforcement element and the base conduit is greater than a width of the annular section.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A swellable packer, comprising:

a base conduit;

at least two reinforcement elements disposed annularly about the base conduit, each comprising:

an annular section; and a stabilizing foot to stabilize the annular section relative to the base conduit, wherein the annular section and the stabilizing foot form a "T" shape; and a swellable material annularly disposed outside the base conduit and in contact with the at least two reinforcement elements, wherein the swellable material is disposed longitudinally in between the at least two reinforcement elements.

2. The swellable packer of claim 1, wherein a height of the annular section is greater than a width of the stabilizing foot.

3. The swellable packer of claim 2, wherein the height of the annular section is at least two times the width of the stabilizing foot.

4. The swellable packer of claim 1, wherein a width of an interface between the at least two reinforcement elements and the base conduit is greater than a width of the annular section.

5. The swellable packer of claim 1, wherein the swellable packer is in:

a run-in-hole position; or an expanded position.

6. The swellable packer of claim 1, wherein the at least two reinforcement elements comprise a plurality of non-helical discs distributed across an axial length of a swelling section of the swellable packer.

7. The swellable packer of claim 1, wherein the reinforcement element is disposed helically around the base conduit.

8. A method, comprising:

introducing a swellable packer in a run-in-hole position into a borehole or wellbore, wherein the swellable packer comprises:

a base conduit;

at least two reinforcement elements, each comprising:

an annular section; and a stabilizing foot to stabilize the annular section relative to the base conduit, wherein the annular section and the stabilizing foot form a "T" shape; and a swellable material concentrically disposed outside the base conduit and in contact with the at least two reinforcement elements, wherein the swellable material absorbs fluid and expands, thereby applying a gripping force to a region of the borehole or wellbore to seal off an annulus around the swellable packer, wherein the swellable material is disposed longitudinally in between the at least two reinforcement elements.

9. The method of claim 8, wherein a height of the annular section is greater than a width of the stabilizing foot.

10. The method of claim 9, wherein the height of the annular section is at least two times the width of the stabilizing foot.

11. The method of claim 9, wherein a width of an interface between the at least two reinforcement elements and the base conduit is greater than a width of the annular section.

12. The method of claim 8, wherein the swellable material comprises a water-swelling material, an oil-swelling material, or both.

13. The method of claim 8, wherein the at least two reinforcement elements comprise a plurality of non-helical structures distributed across an axial length of a swelling section of the swellable packer.

14. The method of claim 8, wherein the reinforcement element is disposed helically around the base conduit.

15. A method, comprising:

sliding two or more reinforcement elements along an outer diameter of a base conduit, wherein each of the two or more reinforcement elements comprises:

a stabilizing foot to stabilize an annular section relative to the base conduit, wherein the annular section and the stabilizing foot form a "T" shape; and depositing a swelling material annularly about the base conduit and one of the two or more reinforcement elements, wherein the swellable material is disposed longitudinally in between the two or more reinforcement elements.

16. The method of claim 15, further comprising: applying primer and/or adhesive to the base conduit and the two or more reinforcement elements; and vulcanizing the swelling material using steam vulcanization.

17. The method of claim 15, wherein the two Lonell or more reinforcement elements comprises: a plurality of non-helical structures disposed axially along a length of a swelling section of the base conduit; or a helical structure winding around the base conduit.

18. The method of claim 15, wherein a height of the annular section is greater than a width of the stabilizing foot; and/or a width of an interface between one of the two or more reinforcement elements and the base conduit is greater than a width of the annular section.

* * * * *